US007966935B2

(12) United States Patent
Loddenkoetter et al.

(10) Patent No.: US 7,966,935 B2
(45) Date of Patent: Jun. 28, 2011

(54) REGISTERING METHOD

(75) Inventors: Manfred Loddenkoetter, Ibbenbueren (DE); Martin Kruempelmann, Lengerich (DE)

(73) Assignee: Windmoeller & Hoelscher KG, Lengerich (DE)

( * ) Notice: Subject to any disclaimer, the term of this patent is extended or adjusted under 35 U.S.C. 154(b) by 998 days.

(21) Appl. No.: 11/883,707

(22) PCT Filed: Jan. 19, 2006

(86) PCT No.: PCT/EP2006/000480

§ 371 (c)(1),
(2), (4) Date: Aug. 3, 2007

(87) PCT Pub. No.: WO2006/081950

PCT Pub. Date: Aug. 10, 2006

(65) Prior Publication Data

US 2008/0156210 A1 Jul. 3, 2008

(30) Foreign Application Priority Data

Feb. 3, 2005 (DE) ..... 10 2005 004 972

(51) Int. Cl.

| | |
|---|---|
| ***B41F 33/00*** | (2006.01) |
| ***B41F 33/08*** | (2006.01) |
| ***B41F 1/34*** | (2006.01) |
| ***B41F 5/16*** | (2006.01) |
| ***B41M 1/14*** | (2006.01) |

(52) U.S. Cl. ..... 101/481; 101/178; 101/211; 101/484; 101/485

(58) Field of Classification Search ..... 101/178, 101/181–185, 211, 484–485
See application file for complete search history.

(56) References Cited

U.S. PATENT DOCUMENTS

| | | | | |
|---|---|---|---|---|
| 4,391,190 | A | 7/1983 | Metzler | |
| 5,056,430 | A | 10/1991 | Bayerlein et al. | |
| 6,199,480 | B1 * | 3/2001 | Leonhardt et al. | 101/248 |
| 6,553,907 | B2 * | 4/2003 | Richards | 101/211 |
| 6,634,297 | B2 | 10/2003 | Poetter et al. | |
| 6,796,226 | B2 * | 9/2004 | Kolbe et al. | 100/171 |
| 7,222,568 | B1 * | 5/2007 | Shemesh et al. | 101/211 |
| 2001/0022143 | A1 | 9/2001 | Stern | |
| 2001/0045166 | A1 | 11/2001 | Albus et al. | |

FOREIGN PATENT DOCUMENTS

| | | | |
|---|---|---|---|
| DE | 29 30 438 | A1 | 3/1981 |
| DE | 42 18 760 | A1 | 12/1993 |
| DE | 199 17 773 | A1 | 11/1999 |
| DE | 101 45 957 | A1 | 10/2002 |
| EP | 0 554 811 | A1 | 8/1993 |

* cited by examiner

*Primary Examiner* — Leslie J Evanisko
*Assistant Examiner* — Marissa L Ferguson-Samreth
(74) *Attorney, Agent, or Firm* — Jacobson Holman PLLC

(57) ABSTRACT

A method for registering a rotary press for a printing process, in which "n" inking systems (Fn) each produce monochrome printed images and print one on top of the other thereby producing n-colored printed images, includes producing the images of a printed material with at least one sensor station, recording information on rotary movements of printing plate cylinders (Dn), and using the images and the information to produce correction signals which actuate the cylinders until a deviation of the images of the respective inking systems from a desired position on the material lies within a defined range of tolerance values. During the registering method, one printing plate cylinder at a time is in the printing position, the sensor station produces the printed images, and the correction signals are obtained based on the image produced by the respective cylinder and the information on the rotary movements of at least one cylinder.

21 Claims, 6 Drawing Sheets

REGISTERING METHOD

CROSS-REFERENCE TO RELATED APPLICATION

This is a national stage of PCT/EP06/000480 filed Jan. 19, 2006 and published in German.

BACKGROUND OF THE INVENTION

1. Field of Invention

The invention relates to a method for registering a rotary press comprising several inking systems.

2. Description of the Prior Art

Registering methods have been disclosed in the prior art. It is possible to differentiate between longitudinal registration and transverse registration depending on the effect of the registration corrections on the webs of material to be printed. Particularly the development of the direct drive technology, which assigns at least one independent drive that can be controlled individually to each cylinder carrying printing plates, has revolutionized the possibilities of the registering methods. The provision of affordable sensor systems or camera systems has decisively improved the possibilities of providing measured values even during the printing process.

Another possibility of differentiating between registering methods according to the prior art calls for the examination of the reference values, which are consulted for determining the deviation of the position of the printed images from their desired position. This possibility of differentiating between registering methods can be used to distinguish between web-web methods and web-cylinder methods. In web-web methods (e.g., DE 199 17 773 A1), the positions of parts of monochrome printed images on the material to be printed that are already printed one on top of the other, thus forming an already polychrome printed image, are compared to one another. Usually, these parts of monochrome printed images are registration marks, which are printed particularly for this purpose by each inking system. Based on the determined deviation of the position of the printed images from their desired position, correction signals are produced, which actuate the drives of the printing plate cylinders until the deviation of the positions of their monochrome printed images on the material to be printed lies within a range of tolerances. One of the weak points of this method is that no registration can be effected if registration marks are printed one on top of the other. In the web-cylinder method (e.g., DE 42 18 760 A1), it is sufficient to scan the position of a monochrome printed image—usually a registration mark—however, once for every inking system. The position of this registration mark at a point in time is then related to information on the rotary movement of the respective printing plate cylinder. This information is usually present in the form of trigger signals, which are provided by rotary transducers or simple switching devices. In this method, the position of the registration mark on the moving material to be printed at a point in time is related to the input of the trigger signals, in order to determine the correction signals.

This method requires one sensor system for every inking system.

SUMMARY OF THE INVENTION

It is the object of the present invention to suggest a registering method, which can be implemented using fewer sensor systems.

The invention is based on a web-cylinder method and it achieves the object mentioned above in that

- during the registering method, the printing plate cylinders are one at a time and successively in the printing position,
- the at least one sensor station records the produced monochrome printed images and
- the correction signals for the actuator(s) of a printing plate cylinder are obtained based on the monochrome image produced by the respective printing plate cylinder and the information on the rotary movements of at least one printing plate cylinder.

The registering method of the invention is particularly suitable for pre-registration. It is possible, in particular, to efficiently implement the pre-registration automatically. A camera system, which is positioned behind the last inking system in the direction of travel of the web, is sufficient for this purpose. It is possible to completely dispense with the printing of registration marks, if appropriate. Additional advantages of the method of the invention will become obvious in the light of the present description.

The following statements serve to promote the understanding of the present invention:

The method of the invention can also be employed before or during a printing process, in which not all inking systems of a multi-color rotary press are used. The shot images of the printed material can be parts of printed images such as registration marks, other image components or even the entire image.

Line scan cameras, light barriers and all possible sensors are suitable for use as a sensor station. As mentioned previously, the information on the rotary movements will often be present in the form of trigger signals. However, all other types of sensor output signals are conceivable, regardless of whether these are digital or analog, trigger signals or transmitter signals. The correction signals can also be present in every conceivable form. As in the case of registering methods disclosed in the prior art, these correction signals usually bring about a temporary acceleration (increase or reduction of the circumferential speed) of the actuated cylinder, so that the latter approaches its desired position. During transverse registration, the position of the printing cylinder is changed transversely to the direction of travel of the web of material to be printed.

One printing cylinder at a time is located in the printing position in the method of the invention, and produces monochrome printed images, which are recorded by the at least one sensor station. Just as in case of a cylinder-web method, the position of the monochrome printed image on the material to be printed at a point in time—during the recording of the printed image by the sensor station—is set in relation to information on the rotary movements of printing plate cylinders, and the angular positions of the printing plate cylinders plotted against the time.

The information mentioned above generates, to a certain extent, a temporal coordinate system, using which it is possible to relate the angular positions of the printing cylinders to the point in time at which the image was shot by the sensor station.

This temporal coordinate system then enables a comparison of the positions of the individual monochrome printed images, which are shot at different points in time by the at least one sensor station. The information on the rotary movements of printing plate cylinders can be, for example, average information on the rotary movements of a group of printing plate cylinders. However, the information on the rotary movements of an individual printing plate cylinder—preferably the one that was initially positioned in the printing position—is most likely to be used. This printing plate cylinder can then continue to rotate during the entire registering process and thus help in generating the information—for example, one trigger signal per revolution. If it is possible to retrieve all the information on the angular positions of one or several printing plate cylinders, it is even conceivable to stop the printing plate cylinder(s), which assume the master function described above, during the registration, and to permit the master signal to be generated simply by the clock of a control device. However, it is then necessary to start the stopped cylinder in-register, and this requirement puts a heavy strain on the drives and their controls. It is therefore preferable to permit the generation of the master signal in the described form by one or more printing plate cylinders, to adjust the inking systems successively in-register relative to the master signal, and then to permit the printing plate cylinder(s) to rotate further in synchronization with the master signal (thus at the same speed), even if the already registered printing plate cylinders in the sleeve roller deviate again from their printing positions in the meantime.

A preferred application of the method of the invention is the pre-registration, in particular of central cylinder machines. Especially when used as a pre-registering method, the method of the invention can be combined with other methods that perform the registration during the printing operation.

However, registering methods of the invention can also be implemented during the ongoing printing operation.

In the event that the images shot by the sensor station are displayed on a screen, it is advantageous to the machine operator, if the representation produces, for example, a linear relationship between a desired position of an image and the image.

Example: The printing plate cylinder, which was first brought into the printing position and has printed, is rotated further, while the registering method is performed at the other printing plate cylinders. The former serves as the master cylinder. It supplies a trigger signal for every revolution. Vertical images of the material to be printed and the monochrome printed images printed thereon are visible on a screen, which can be seen from the control desk of the printing machine. These vertical images are shot by a sensor station, which is disposed behind the last inking system in the direction of travel of the material to be printed, when the trigger signal notifies the completion of a revolution of the master cylinder. On the screen, a screen marking is visible in form of a sharp line, which runs transversely to the transfer direction of the web of material to be printed.

In this example, the registering method proceeds as follows:

Initially, a first printing plate cylinder—"master cylinder"—is brought into the printing position. Its angular position is corrected by correction signals, which are triggered by the machine operator in this example at the push of a button, until the front edge of the monochrome printed image of the master cylinder is flush with the screen marking. In this connection, this means that the front edge of the monochrome image reaches the screen marking, when the trigger signal indicates the completion of a revolution of the master cylinder.

Thereupon, the master cylinder is switched off from the printing position, but it continues to rotate in the switched-off position. The machine operator adjusts the angular positions of the other cylinders one after the other by means of additional correction signals in such a way that the front edges of these cylinders also abut against this marking at every trigger signal of the master cylinder. In this way the angular positions of all printing plate cylinders are aligned with that of the master cylinder.

The distance of the printed image from the marking is shown to be linear on the screen, in order to facilitate the work of the machine operator.

At the end of this registering method, the angular positions of all printing plate cylinders are well coordinated to each other.

However, it must be emphasized in the light of this example that it is often required to successively shoot several images of the printed material, in order to arrive at an appropriate conclusion about the defective position of the printing plate cylinder. In this case, the positional information of the individual shots is objectified, for example, by determining the average.

The vertical images mentioned above can also be improved in this way.

The simultaneous representation of monochrome printed images of different inking systems can also be of use during the visualization of the register errors.

For a machine operator performing the registration, it is advantageous particularly in this case, if those printed images of different inking systems that were shot at different points in time as mentioned above, are displayed at the same time. This simultaneous display usually requires an intermediate storage of the images.

In this case also, it is recommended to represent a desired position by means of a marking while deviations from these desired positions are represented to scale. This can be effected on several screens, or on one screen that is divided into several parts. It is markedly user-friendly if these different printed images are represented side by side, wherein their positions in the printing direction suggest the deviation of their positions from a desired position. Another possibility requires the machine operator to affix markings on the different monochrome printed images. It is particularly advantageous if he does this at those locations of the monochrome printed images that he knows are located one on top of the other in the polychrome printed image. Then the control device can calculate the correction signals, which ensure that these two markings are printed on top of each other on the web of material to be printed at a defined angular position of the master cylinder(s). The same can also happen without machine operators, if a control device sets such markings, or if it uses specific points in the monochrome printed images for the purpose described above.

It is advantageous if a printing machine contains control devices for implementing the methods of the invention, which control devices enable a part of the method described and claimed in this invention to be implemented automatically.

A rotary press for implementing the methods of the invention is usually equipped with sensor arrangements, which the material to be printed passes after the last inking system disposed at the counter-impression cylinder, since sensor arrangements disposed in such a manner can shoot the printed images of all of these inking systems. It is often recommended to accommodate two camera systems into such a sensor arrangement, in order to be able to firstly shoot the entire printed image and secondly to adequately shoot specific surface elements that are suitable for registration. Often such camera systems may then also be used both for setting the rollers into motion as described in the document U.S. Pat. No. 6,634,297 B2 and for registration in accordance with the present invention. When setting the rollers into motion over the entire width of the printed image, for example, a line scan camera could be used, which can cover the entire printing width. A second camera system would then focus on those segments of the images that are suitable for the purpose of registration—such as marks, crosses or even those components of images that are randomly particularly suitable for registration purposes.

BRIEF DESCRIPTION OF THE DRAWINGS

Additional exemplary embodiments of the invention will be explained below with reference to the description and the claims. The figures show:

Figure 1:
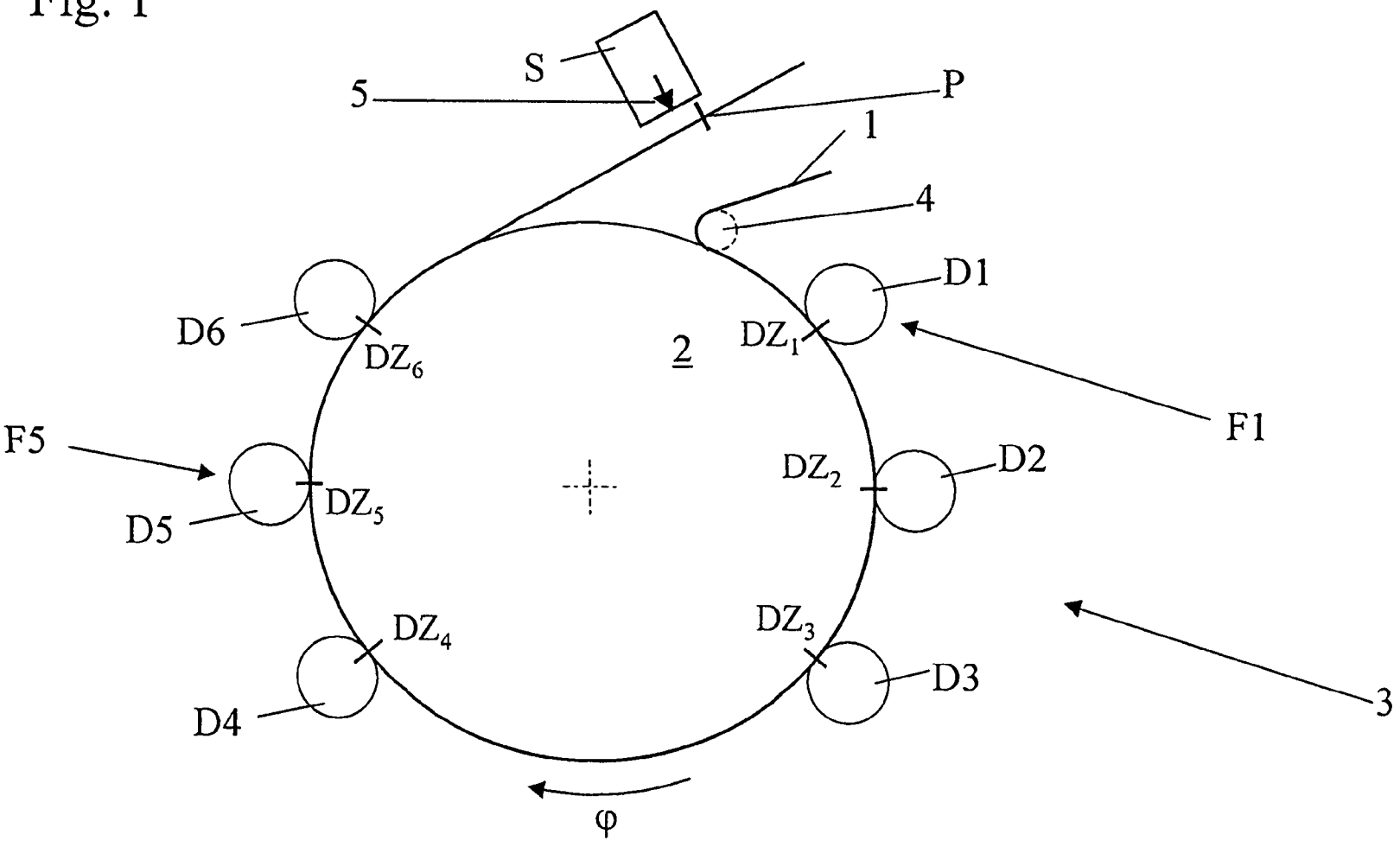
Figure 2:
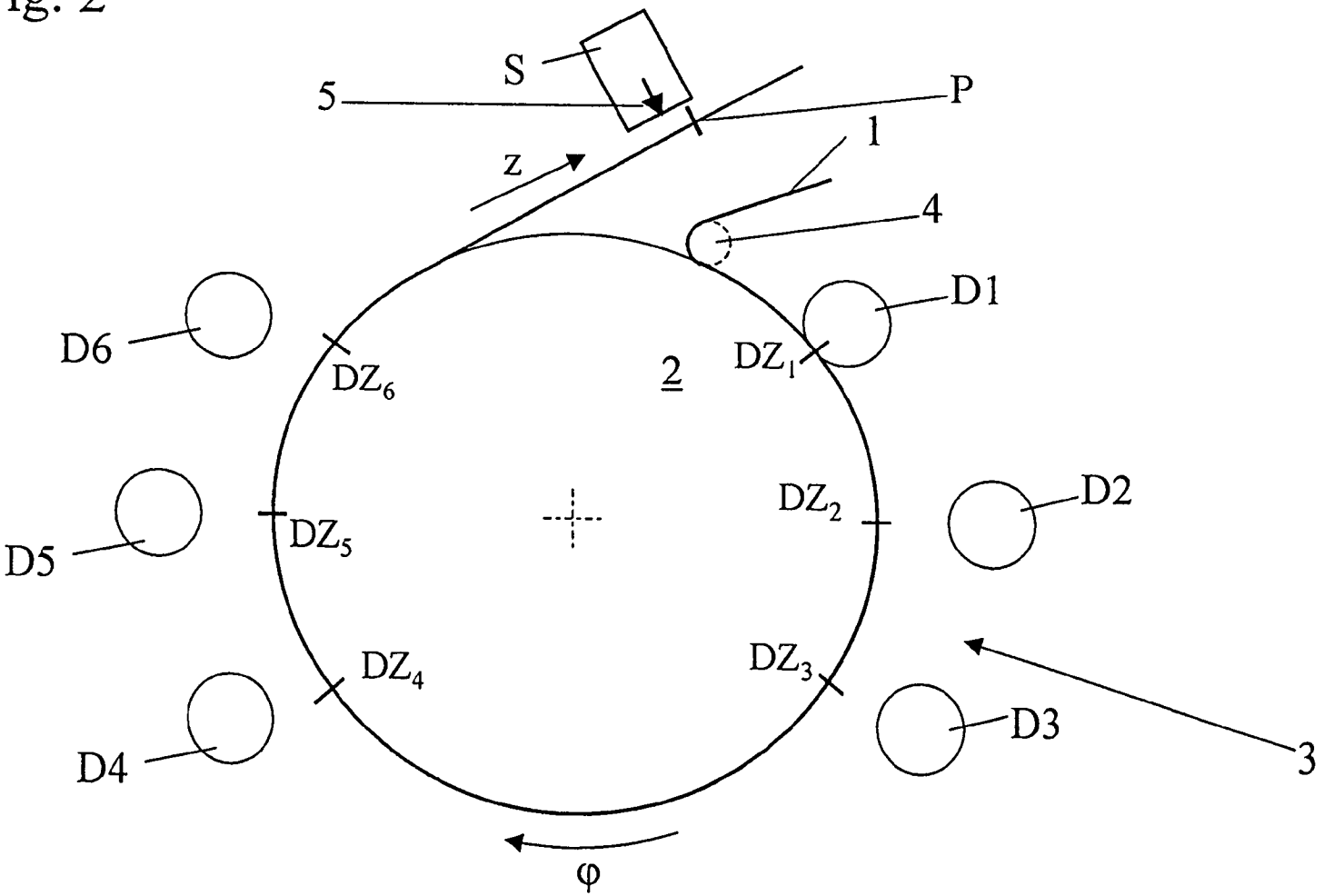
Figure 3:
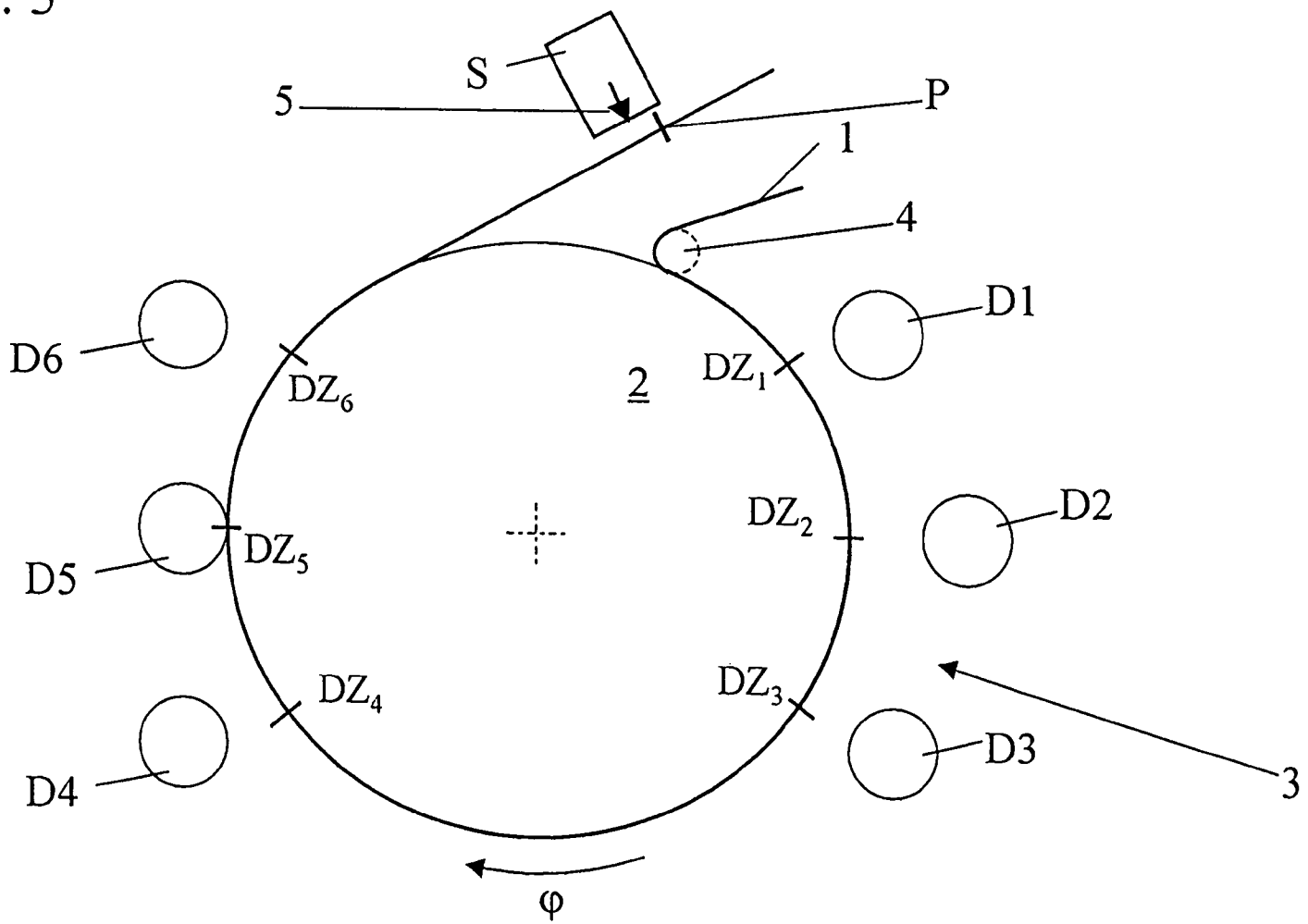
Figure 4:
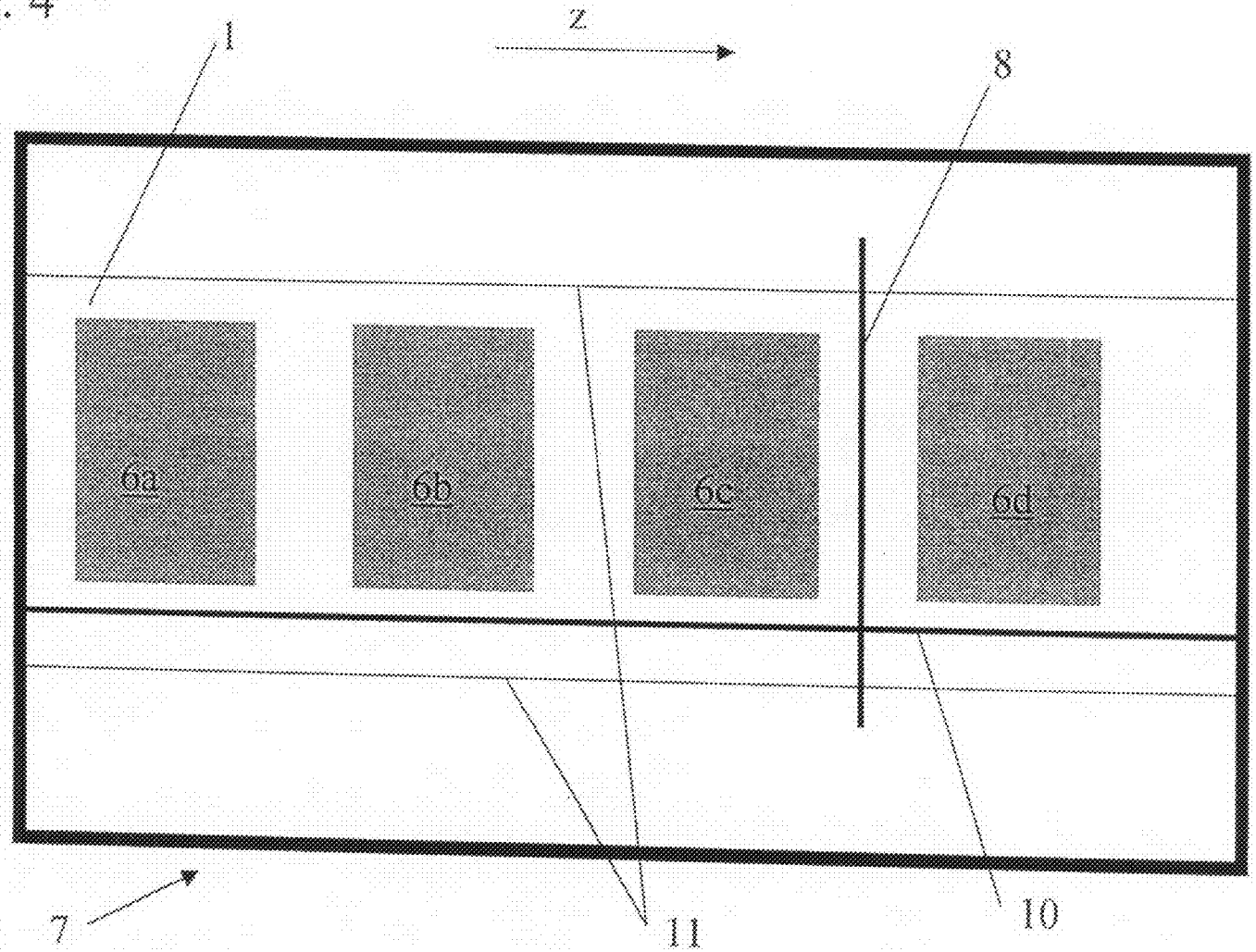
Figure 5:
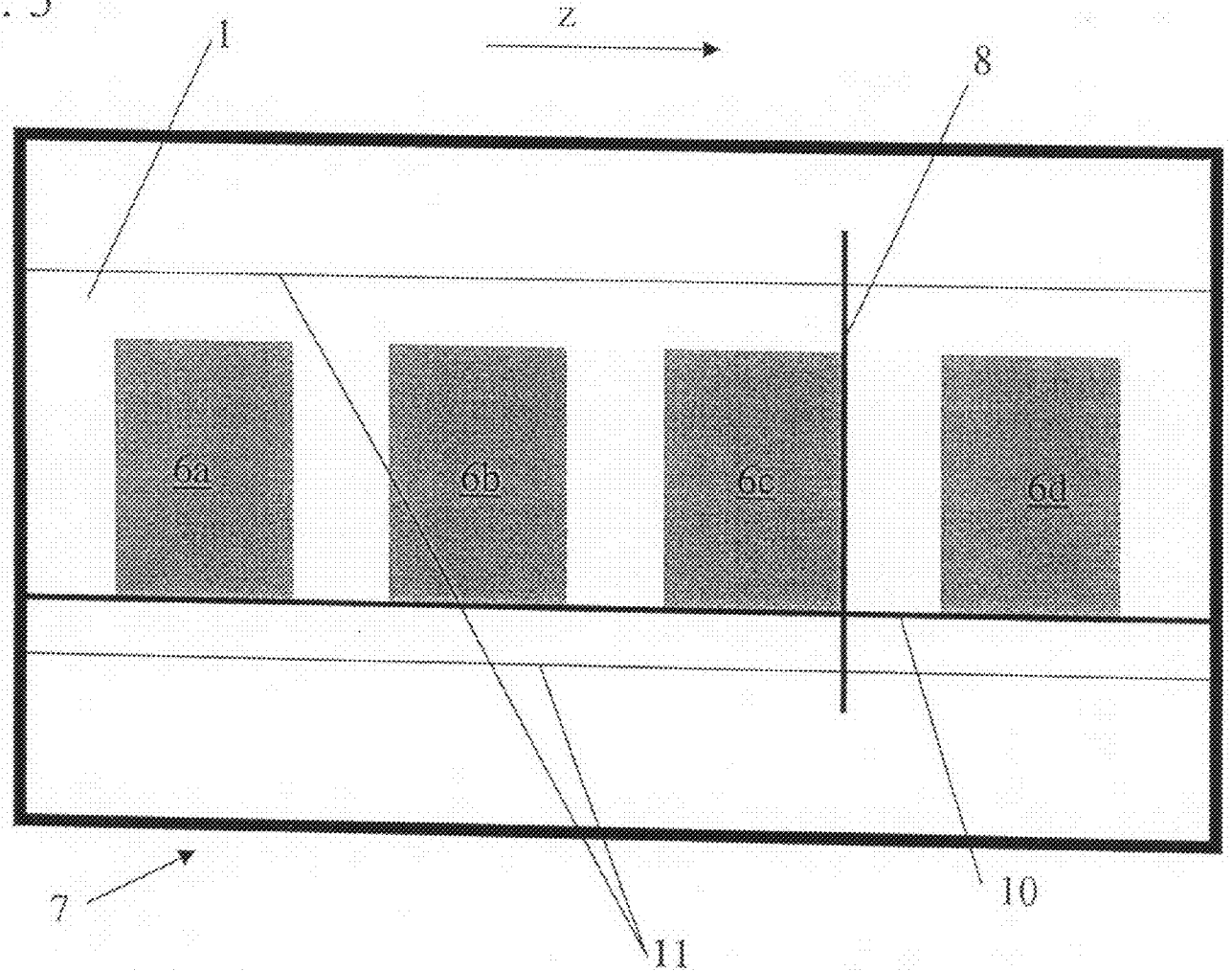
Figure 6:
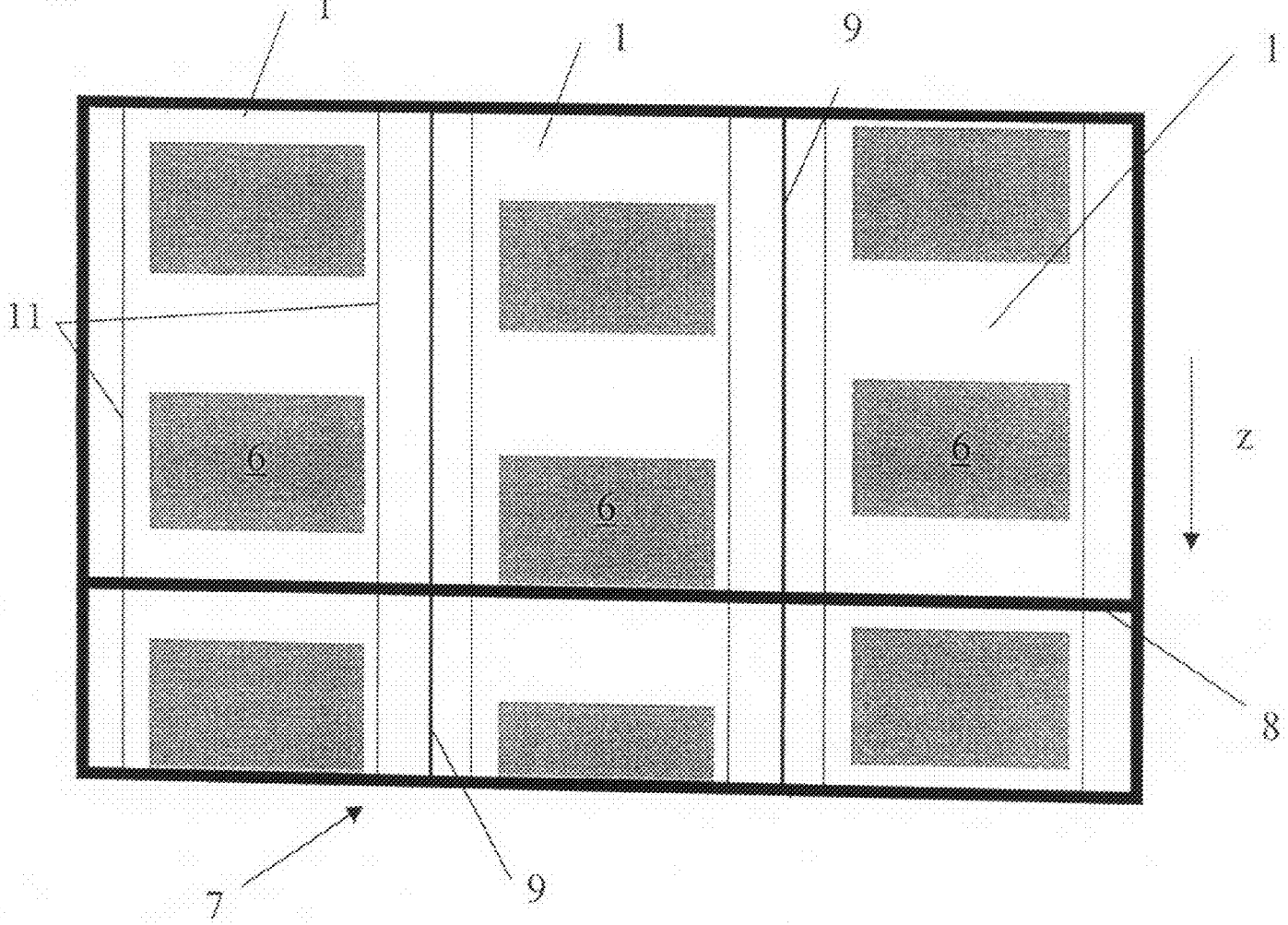

| | |
|---|---|
| FIG. 1 | is a functional sketch of a central impression flexographic press |
| FIG. 2 | is the functional sketch, shown in FIG. 1, when implementing a registering method of the invention |
| FIG. 3 | is the functional sketch, shown in FIG. 1, when implementing a registering method of the invention |
| FIG. 4 | is a schematic representation of a screen image when implementing a registering method of the invention |
| FIG. 5 | a second schematic representation of a screen image when implementing a registering method of the invention |
| FIG. 6 | a third schematic representation of a screen image when implementing a registering method of the invention |

DETAILED DESCRIPTION OF THE PREFERRED EMBODIMENTS

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

FIG. 1 shows a functional sketch of a central impression flexographic press 3 during the execution of a print job, for which all six inking systems Fn (i.e., F1, F2, F3, F4, F5, F6) are required. Therefore all printing plate cylinders D1 to D6 are shown in their printing positions.

The functional sketch illustrated shows only the counter-impression cylinder 2 and the printing rollers D1 to D6 out of the standard mechanical components of such a machine. The other components are known to those skilled in the art to a sufficient extent and are likewise shown in the cited document U.S. Pat. No. 6,634,297 B2. After the web of material to be printed 1 was pressed slightly by the guide roller 4 against the central counter-impression cylinder 2, the web 1 is guided by the counter-impression cylinder 2 past the printing cylinders D1 to D6. Here the web 1 goes through the print zones DZ1 to DZ6 between the respective printing cylinders D1 to D6 and the counter-impression cylinder 2, in order to be printed there. Finally the web 1 leaves the counter-impression cylinder 2 after the last print unit F6 and passes the sensor station S in its transfer direction z. During the transport of the web 1 by the counter-impression cylinder 2, the slip between these elements is negligible. The arrow 5 symbolizes the camera direction of the sensor station S. The point P illustrates that position of the web of material to be printed, at which the screen marking 8 is located on the screen 7 of the FIGS. 4 to 6.

FIG. 2 shows the same functional sketch at the beginning of an example of a registering method of the invention. Only the printing cylinder D1 is positioned on the counter-impression cylinder 2, and prints the web of material to be printed 1 with a monochrome printed image 6. The registering method proceeds in FIG. 3. The registration was already performed at the printing plate cylinders D1 to D4. After their registration, these cylinders D1 to D4 were again switched off from the counter-impression cylinder 2 and they continue to rotate at the same speed. Only the printing plate cylinder D5 is printing at the point in time shown in FIG. 3. The registration of the cylinder D6 is still pending. Suitable sensors at the printing plate cylinder D1, which was registered before the other cylinders, supply a trigger signal during each completed revolution of this cylinder, thereby causing the sensor arrangement S to shoot an image of the web of material to be printed.

The cylinder D1 thus assumes a master function. FIG. 4 shows a schematic representation of an image on the screen 7. The image shows the web of material to be printed 1 with its two edges 11, which carries the monochrome printed images 6*a* to 6*d*. The image is recorded by the sensor arrangement S, before the registration is effected. For this reason the front edge of the monochrome printed image 6*c* in the transfer direction of the web z is still at a distance from the screen marking 8 for the longitudinal registration. This screen marking corresponds to the illustration of the position P of the screen marking and can by all means also be affixed stationarily to the machine frame.

The screen marking for the transverse registration 10 is also visible. The distance between the lower edge of the printed images 6*a* to 6*d* from the screen marking 10 also shows that the transverse registration is still pending here.

FIG. 5 shows a schematic representation of an image on the screen 7, which clarifies the final registering method at a printing cylinder in this exemplary embodiment in that the lower edges of the images 6*a* to 6*d* abut against the screen marking 10 and that the front edge of the printed image 6*c* runs flush with the screen marking 8. During the representation of monochrome printed images 6, it is usually sufficient to have a small number of printed images 6 of an inking system Fn on a screen. In FIG. 6 a screen 7 is represented, on which printed images 6 coming from different inking systems are represented at the same time. Since these inking systems Fn have printed and have been registered at different points in time, such a representation requires at least one intermediate storage of monochrome printed images 6. However, this measure can also be advantageous if such a simultaneous representation on a screen 7 is not at all intended.

At this point, reference should be made once again to U.S. Pat. No. 6,634,297 B2 and to parallel applications like DE 101 45 957 A1. These documents deal with the details of automatic additional setting processes, wherein the printing plate cylinders of a rotary press are appropriately positioned on their counter-impression cylinder/s. The details of these additional setting processes (such as e.g., the evaluation of the intensity of the light reflected by the printed image, the observation of this light intensity curve during the additional setting process, comparison with a digital desired image or the registration of a specific light intensity curve etc.), as well as the layout of the printing machine for implementing this method (equipping the printing machine with a camera, type of the camera, programming of the control device etc.) are essential for the understanding of these lines and are thus included in the scope of the disclosure of the present invention.

Naturally, the so-called additional setting process is effected at the beginning of a print job. In a multi-color printing machine, this additional setting process is usually effected similarly to the registering method described with reference to the figures, in that the individual inking systems successively produce monochrome printed images, which are preferably recorded by a sensor arrangement disposed downstream of the last print unit Dn in the direction of travel z of the web 1. The images 6*a*-6*d* recorded by the sensor arrangement are examined. The additional setting process is regulated on the basis of this examination.

The images obtained in this manner can also be used for a registering method of the invention. Therefore, all possible combinations of the additional setting process described in U.S. Pat. No. 6,634,297 B2 and the registering method claimed in this document are considered to be advantageous.

In addition, the two methods use the same or similar hardware components.

It also appears possible, according to another characteristic of the method of the invention, to register groups of printing plate cylinders instead of the sequential registration of individual printing plate cylinders. Due to the following considerations, it appears advantageous, if the number of the printing plate cylinders in these groups is smaller than the number "n" of the printing plate cylinders that are active in the printing process.

Those registering methods, in which, for example, dichromatic printed images are then evaluated instead of monochrome printed images, would be faster to implement than registering methods implemented based on monochrome printed images.

For this method it would be advantageous to use one or more cameras, which can resolve the spectral ranges of the monochrome printed images from a polychrome printed image against each other. That appears possible particularly due to the reflected light of those regions of the polychrome printed image, in which only one color was applied. In the regions, in which two or more printed images have been printed one on top of the other, an evaluation of the polychrome printed image appears more difficult. In the case of an eight-colored or a ten-colored printed image, such regions will be more difficult to find than in a two or a three-colored printed image.

The additional setting process based on polychrome printed images, which additional setting process is described in the documents U.S. Pat. No. 6,634,297 B2 and DE 101 45 957 A1, the disclosure of which must also be consulted here for the understanding of this passage, can also be effected under the prerequisites outlined above. Here also, all combinations of registering or pre-registering methods and additional setting processes based on polychrome printed images appear reasonable.

The invention being thus described, it will be apparent that the same may be varied in many ways. Such variations are not to be regarded as a departure from the spirit and scope of the invention, and all such modifications as would be recognized by one skilled in the art are intended to be included within the scope of the following claims.

| List of reference numerals | |
|---|---|
| 1 | Web of material to be printed |
| 2 | Counter-impression cylinder |
| 3 | Central impression flexographic press |
| 4 | Guide roller |
| 5 | Arrow in the camera direction of the sensor arrangement |
| 6 | Monochrome printed image |
| 7 | Screen |
| 8 | Screen marking for longitudinal registration |
| 9 | Division of the screen |
| 10 | Screen marking for transverse registration |
| 11 | Edges of the web of material to be printed |
| Dn | Printing plate cylinder/printing cylinder of the nth print unit |
| DZn | Print zone of the nth print unit |
| S | Sensor arrangement |

-continued

| List of reference numerals | |
|---|---|
| P | Illustration of the position of the screen marking |
| ϕ | Circumferential speed/direction of rotation of the counter-impression cylinder |
| n | Number of print units, using which the printing process is performed |
| z | Transfer direction of the web of film |

What is claimed is:

1. A method for registering a rotary press for a printing process wherein in which "n" inking systems (Fn) each produce monochrome printed images and print one on top of the other thereby producing n-colored printed images, the method comprising recording the monochrome printed images of a printed material with at least one sensor station (S), recording information on rotary movements of printing plate cylinders (Dn), and using the monochrome printed images and the information to produce correction signals, which actuate one or more actuators of the printing plate cylinders until a deviation of the monochrome printed images of the respective inking systems from a desired position on the material to be printed lies within a defined range of tolerance values, including, providing only one of the printing plate cylinders at a time in a printing position, using the at least one sensor station to record the monochrome printed images, and obtaining the correction signals for the one or more actuators of the printing plate cylinder based on the monochrome printed image produced by the respective printing plate cylinder and the information on the rotary movements of at least one of the printing plate cylinders.

2. The method according to claim 1, wherein at least one of the printing plate cylinders, which is not in a printing position, is driven further.

3. The method according to claim 2, wherein the at least one driven printing plate cylinder, which is not in the printing position, is driven at a same circumferential speed as the cylinder that is currently printing.

4. The method according to claim 3, wherein the information on the rotary movements of the at least one driven printing plate cylinder, which is not in the printing position, is used to determine the correction signals.

5. The method according to claim 1, wherein the information on the rotary movements of a driven printing plate cylinder, which is not in the printing position, is used to determine the correction signals.

6. The method according to claim 1, wherein the information on the rotary movements of the printing plate cylinder, which was first in the printing position, is used to determine the correction signals.

7. The method according to claim 1, wherein the method is used for pre-registration.

8. The method according to claim 1, wherein positions of the monochrome printed images are displayed on at least one screen in a functional relationship to a position which the monochrome printed images had each assumed at a time of a specific angular position of the printing plate cylinders.

9. The method according to claim 8, wherein the functional relationship is linear.

10. The method according to claim 1, wherein the monochrome printed images, which are printed by different printing plate cylinders on different surface sections of the material to be printed, are displayed simultaneously on at least one screen.

11. The method according to claim 1, the wherein relative positions of the different monochrome printed images in relation to one another are at least partially adjusted by a machine operator observing at least one screen and performs adjustments.

12. The method according to claim 1, wherein the monochrome printed images on different surface sections are displayed on at least one screen together with a screen marking, which determines a desired position of the monochrome printed images.

13. The method according to claim 12, wherein at least two of the monochrome printed images are displayed on at least one screen, and that a machine operator provides points of the at least two monochrome printed images with additional markings.

14. The method according to claim 13, further comprising using a control device to provide additional markings in at least two of the monochrome printed images.

15. The method according to claim 14, wherein the control device relates the desired position of the additional markings and/or specific patterns in the at least two monochrome printed images to the information on the rotary movements of the printing plate cylinders, the correction signals are obtained based on relative deviations of the position of the additional markings in relation to one another in the at least two monochrome printed images and the information on the rotary movements of the printing plate cylinders, and the desired position of the monochrome printed images on the material to be printed is achieved, if a distance of the monochrome printed images from the additional markings lies within the defined range of tolerances tolerance values.

16. The method according to claim 1, further comprising at least partially adjusting relative positions of the monochrome printed images in relation to one another by using a computing unit to recognize specific patterns in at least one of the monochrome printed images, compare the recognized patterns to a desired position in a polychrome image, and calculate correction signals based on the comparison.

17. The method according to claim 1, wherein the desired position is determined based on the position of the monochrome printed image on the material to be printed.

18. The method according to claim 1, wherein the registering is based on monochrome printed images that were produced during an additional setting process.

19. A rotary press for implementing the method according to claim 1.

20. The rotary press according to claim 18, further comprising the at least one sensor station, which is disposed in a direction of travel (z) of a web of the material to be printed downstream of a last inking system.

21. The rotary press according to claim 20, wherein the sensor station includes a first and a second camera system, the first camera system being configured for scanning an entire printing surface of the monochrome printed image with low resolution and the second camera system being configured for scanning a partial surface of the monochrome printed image with high resolution.

* * * * *